US005683310A

United States Patent [19]

Chen

[11] Patent Number: 5,683,310

[45] Date of Patent: Nov. 4, 1997

[54] METAL HEAD OF GOLF CLUB

[76] Inventor: Archer C. C. Chen, 35, Yichaone E. Road, Taipin, Taichung County, Taiwan

[21] Appl. No.: 675,711

[22] Filed: Jul. 2, 1996

[51] Int. Cl.[6] ..... A63B 53/04

[52] U.S. Cl. ..... 473/349; 473/350

[58] Field of Search ..... 473/349, 350, 473/282, 324, 256, 291, 334, 335, 336, 337, 345

[56] References Cited

U.S. PATENT DOCUMENTS

| | | | |
|---|---|---|---|
| 3,997,171 | 12/1976 | Currie | 473/349 |
| 5,074,563 | 12/1991 | Gorman | 473/350 |
| 5,330,187 | 7/1994 | Schmidt | 473/350 |
| 5,447,311 | 9/1995 | Viollaz | 473/350 |
| 5,492,327 | 2/1996 | Biafore | 473/350 |
| 5,536,011 | 7/1996 | Gutowski | 473/350 |
| 5,540,436 | 7/1996 | Boone | 473/350 |

FOREIGN PATENT DOCUMENTS

| | | | |
|---|---|---|---|
| 2251556 | 7/1992 | United Kingdom | 273/167 R |

*Primary Examiner*—Sebastiano Passaniti
*Attorney, Agent, or Firm*—Browdy and Neimark

[57] ABSTRACT

A golf club head comprises a neck, a heel, a face, a toe, a top and a sole. The neck, the heel and the face are made integrally of a light alloy while the top, the toe and the sole are made of a metal, which is heavier than the light alloy, so as to surround the periphery of the face. The sole is provided on the rear edge thereof with a projection so as to form an empty back. The face is provided with an inclined side slanting from a surface thereof toward the back. The top, the toe and the sole form a heavy metal circular frame surrounding the face made of the light alloy.

2 Claims, 2 Drawing Sheets

METAL HEAD OF GOLF CLUB

FIELD OF THE INVENTION

The present invention relates generally to a golf club head, and more particularly to a metal head of the golf club.

BACKGROUND OF THE INVENTION

A prior art metal head of the golf club is composed of a face having a relatively heavy periphery for forming a greater sweet spot. In addition, the center of gravity of such metal head is located at a lower position toward the back of the head. However, such a prior art metal head of the golf club as described above is defective in design in that the neck and the heel of the metal head are relatively heavy, and that the center of gravity of the metal head is not located towards the toe of the metal head.

SUMMARY OF THE INVENTION

The primary objective of the present invention is to provide a golf club metal head which is relatively large in size and has a properly-located center of gravity.

The foregoing objective of the present invention is attained by a golf club metal head, which comprises a neck, a heel, a face, a toe, a top, and a bottom, The neck, the heel and the face are made integrally of a light alloy. The top, the toe and the bottom are made of an alloy which is heavier than the light alloy referred to above. The face is surrounded by the top, the toe and the bottom. The bottom has a rear edge of a predetermined height and extending upwards so as to provide the metal head with a sole containing an empty space. The metal head is provided in the interior thereof with a cavity. The face has an outer side slanting from the front face thereof toward the back face thereof. The face is surrounded by the top, the toe and the bottom, which are made of an alloy heavier than the alloy of which the face is made.

DETAILED DESCRIPTION OF THE INVENTION

Figure 1:
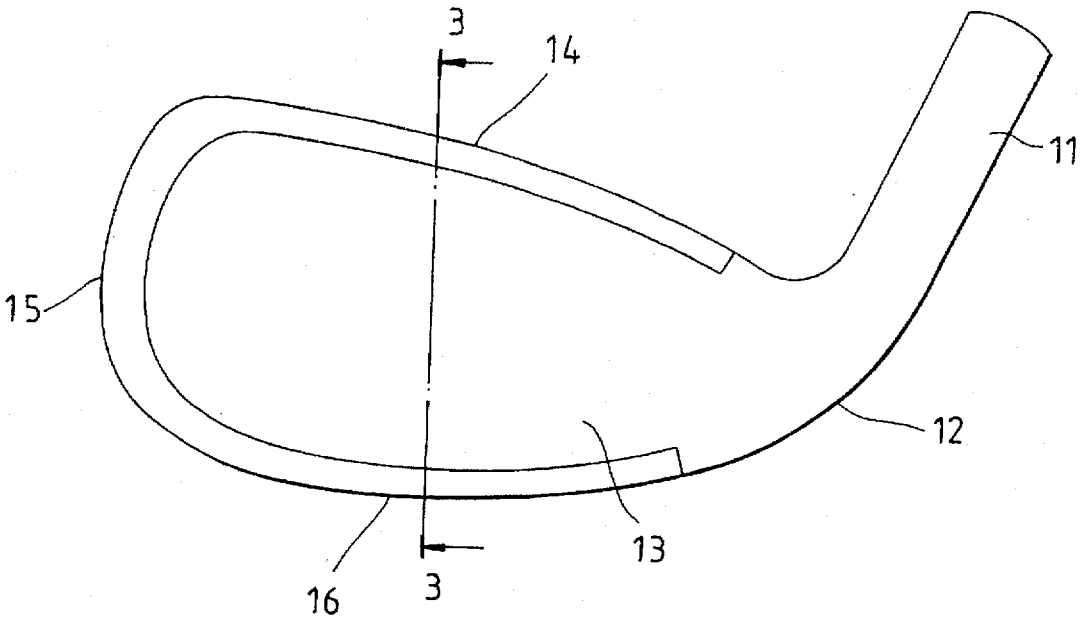
FIG. 1 shows a front view of a preferred embodiment of the present invention.
Figure 2:
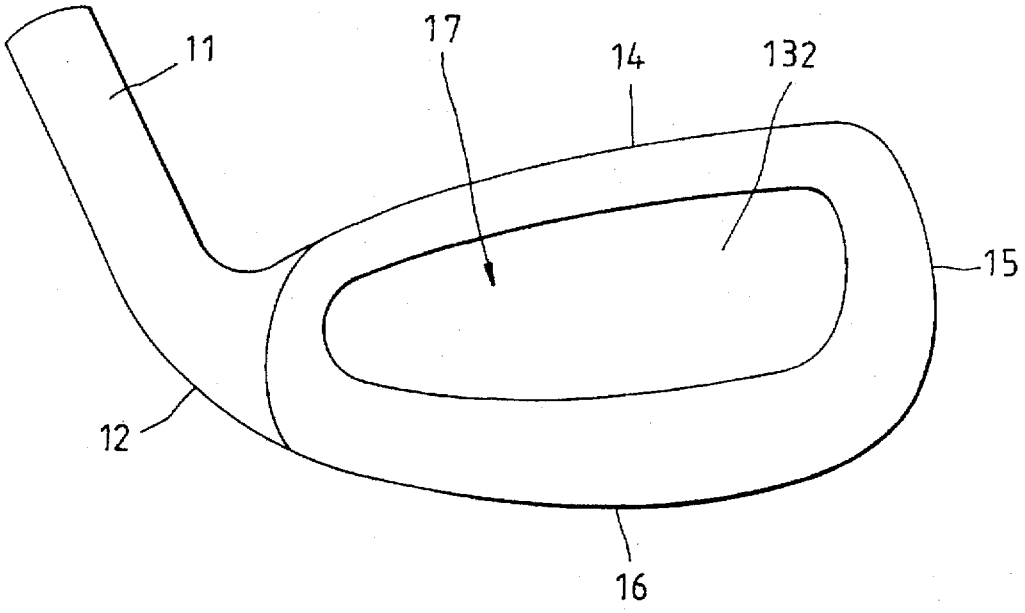
FIG. 2 shows a rear view of the preferred embodiment of the present invention.
Figure 3:
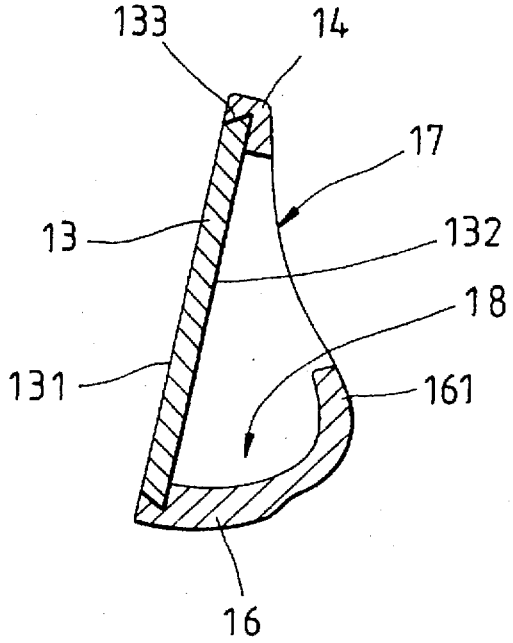
FIG. 3 shows a sectional view of a portion taken along the line 3—3 as shown in FIG. 1.

As shown in FIGS. 1–3, a golf club head of the present invention comprises a neck 11, a heel 12 and a face 13, which are made integrally of a light alloy, such as a titanium alloy. The golf club head of the present invention further comprises a top 14, a toe 15, and a sole 16, which are made of a metal material, such as a stainless steel or copper material, which is heavier than the light alloy referred to above. The face 13 has an inclined outer side 131 and back 132 slanting from the sole 16 toward the top 14. The above-mentioned heavier metal forms a circular frame surrounding the periphery of the face 13 to join with the inclined side 133. The sole 16 is provided at the rear edge thereof with a flat projection 161 of a predetermined height and extending upwards. The back 17 is empty. The head is provided in the interior thereof with a cavity 18.

The neck 11, the heel 12 and the face 13 are made integrally of the light alloy and are therefore reduced in the weight ratio to the extent that the face 13 is as thin as 2–3.5 mm, and that the head size is increased. The face 13 is surrounded by the heavier metal so as to result in an increase in the size of the sweet spot. The center of gravity of the golf club head of the present invention is relocated downwards and rearwards, thanks to the flat projection 161 of the sole 16.

Figure 4:
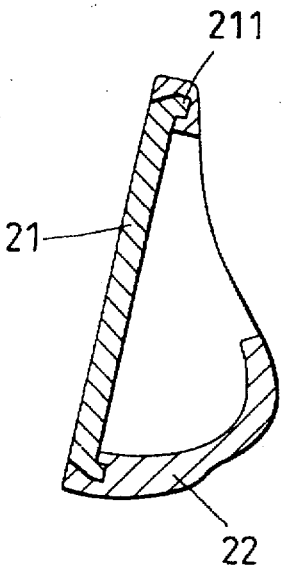
FIG. 4 is similar to FIG. 3 to show the construction of another kind of face of the golf club head of the present invention.

As shown in FIG. 4, a face 21 is provided on the back of the periphery thereof with a shoulder 211 extending rearwards such that the shoulder 211 is completely enclosed by the heavy metal circular frame 22 made up of the top, the toe and the sole. The shoulder 211 serves to reinforce the structural strength of the periphery of the face 21.

What is claimed is:

1. A golf club metal head comprising a neck, a heel, a face, a toe, a top and a sole; wherein said neck, said heel and said face are made integrally of a light alloy while said top, said toe and said sole are made of a metal which is heavier than said light alloy, so as to surround a periphery of the face, said sole provided on a rear edge thereof with a projection of a predetermined height spaced from the face and extending toward the top so as to form an empty back; wherein said face is provided with an inclined side slanting from the sole toward the top; and wherein said top, said toe and said sole form a heavy metal circular frame surrounding said face made of said light alloy.

2. The golf club metal head as defined in claim 1, wherein said face is provided on a back of a periphery thereof with a shoulder extending rearwards such that said shoulder is completely enclosed by said heavy metal circular frame made up of said top, said toe and said sole.

* * * * *